United States Patent [19]

Quinard

[11] 4,271,974

[45] Jun. 9, 1981

[54] BOTTLE WITH PREALIGNED CLOSURE

[75] Inventor: Yves Quinard, Boisemont, France

[73] Assignee: Parfums Rochas, Paris, France

[21] Appl. No.: 57,256

[22] Filed: Jul. 12, 1979

[30] Foreign Application Priority Data

Oct. 17, 1978 [FR] France ..... 78 29505

[51] Int. Cl.[3] ..... B65D 41/04

[52] U.S. Cl. ..... 215/331

[58] Field of Search ..... 215/331, 330, 334; 220/288

[56] References Cited

U.S. PATENT DOCUMENTS

| | | | |
|---|---|---|---|
| 495,299 | 4/1893 | Calcutt | 215/331 X |
| 1,669,579 | 5/1928 | Scofield | 215/331 |
| 3,249,248 | 5/1966 | Metzendorf | 215/334 |
| 3,454,181 | 7/1969 | Riss | 220/288 |
| 4,093,096 | 6/1978 | Augros | 215/331 X |

FOREIGN PATENT DOCUMENTS

| | | | |
|---|---|---|---|
| 1047251 | 7/1953 | France | 215/334 |

*Primary Examiner*—Donald F. Norton

*Attorney, Agent, or Firm*—Hammond & Littell, Weissenberger and Muserlian

[57] ABSTRACT

A bottle with a prealigned closure means comprising a bottle with a neck on the top thereof provided with a threading and a collar at the base thereof having stop shoulders, said shoulders each having an oblique side with an associated inclination angle, a capsule with a closed end provided with an interior threading adapted to engage the threading of the bottle neck, a hollow cap means with the capsule axially disposed therein and provided with means to immoveably secure the capsule with respect to the cap, the lower edge of the capsule being provided with two diametrically opposite grooves in the form of a right-angle triangle whose side opposite the smaller of the acute angles is parallel to the axis of the capsule, the said smaller acute angle determining the inclination of the oblique side of the said right-angled triangle, said smaller acute angle being greater than the inclination angle of the stop shoulders of the bottle with which the grooves are destined to cooperate.

3 Claims, 7 Drawing Figures

BOTTLE WITH PREALIGNED CLOSURE

STATE OF THE ART

Numerous means of closing a bottle are known. Among them, some of them try to resolve the problem of a determined position of the closure means with regard to the bottle when it is closed, that is to say to assure the adjustment of the means always in the same way with regard to the bottle it is closing, while assuring simultaneously the required hermetic closing.

The adjustment and the maintenance of such a means in the same determined position becomes more important especially in the case where the chosen shape of the closure means and of the bottle it is associated with, are not circular. In this event, to insure the exterior sight of the whole closed bottle may be always identical, the edge, for example, has to be aligned even after numerous openings and closings and not run the risk being displaced by accident.

Although known means are theoretically supposed to assume these functions at the beginning, after filling, and once in service, they often give rise to unsatisfactory results after an extended use of the bottle or due to an accidental unscrewing. These failures may be due to construction or to the materials that they are made of.

The unintentional displacement of such a closing means with regard to the bottle it is closing, apart from the displacement from the required determined position, also may lead to loss of tightness and leakage of the contents of the bottle. It is thus important to take into account the danger that such a closing means for a bottle avoids an accidental unscrewing. Such a situation may occur for example, during the daily carrying of a bottle in a bag or during various manipulations. This accidental unscrewing and consequent displacement of said means with regard to the bottle it is closing may more frequently occur with bottles and caps whose shapes are not circular.

The risk that the edges of such a means hang is present at any time and it will result in first an unscrewing of said means out of the required determined position and the unscrewing will continue until the hermetic state fails. All these dangers are of the greatest importance when it is concerns the closing of containers containing pharmaceutical or parapharmaceutical compounds.

Besides such containers, it also concerns containers for compounds which are more or less volatile and at the same time often odorous, malodorous or flammable. Such cases occurs in storage of perfumers or cosmetic compositions such as toilet waters, lotions, or liquid creams.

The storage of such materials besides requiring an imperative and permanent tightness of the bottle, may be an important factor in the commercial success of the product. The consumer would thus appreciate the fact that the bottle being bought, even after long use and at all occasions presents to his eyes the same attractive aspect which attracted him at the time of the purchase. Therefore, in the course of storage of the said materials, the choice of closing means for the bottle and the shape of said bottle takes a great importance.

Most means for closing said bottles which try to satisfy simultaneously the tightness requirement and the condition of unalterable esthetic aspect of the whole closed bottle do not satisfy these conditions.

To avoid these disadvantages, a new means of the invention has been made which overcome the disadvantage of the prior bottles. The bottle of the invention is comprised of a bottle with a neck on the top thereof provided with a threading and a collar at the base thereof having stop shoulders, said shoulders each having an oblique side with an associated inclination angle, a capsule with a closed end provided with an interior threading adapted to engage the threading of the bottle neck, a hollow cap means with the capsule axially disposed therein and provided with means to immoveably secure the capsule with respect to the cap, the lower edge of the capsule being provided with two diametrically opposite grooves in the form of a right-angle triangle whose side opposite the smaller of the acute angles is parallel to the axis of the capsule, the said smaller acute angle determining the inclination of the oblique side of the said right-angled triangle, said smaller acute angle being greater than the inclination angle of the stop shoulders of the bottle with which the grooves are destined to cooperate. The expression "the said determined position" of the closing means is the position in which the cap of the closing means of the invention, has acquired the required position with respect to the bottle to give to the entire bottle the harmonic shape required to guarantee, after each closing, the required esthetic aspect.

In the following figures, the expression "bottle with a stop shoulder(s)"; is intended to mean a bottle having one or more stop shoulders. This shoulder or these shoulders may be of different shapes and particularly in the case of the bottle which is to be closed by the present invention, this or these shoulders have the appearance of a pin, which in perspective, occurs in the form of a triangle.

The closure means according to the invention may also be characterized by the following parts: means for preserving the determined position of the system constituted by two diametrically off-set grooves, executed on the lower edge from the capsule in the form of a right-angled triangle, whose side opposite to the smaller of the acute angles is parallel to the axis of the capsule, this acute angle determining the inclination of the oblique side of said right-angled triangle being greater than the inclination angle from the inclination of the stop shoulders of the bottle with which the grooves are destined to cooperate. The smaller of the acute angles of the right-angled triangle in the form of which are made the grooves of the lower edge from the obturatory capsule, is determined by the length from the side of said triangle parallel to the axis of said capsule which length is equal to the quotient of the value of the screw thread and of the number of the grooves.

The length of the side of the right-angled triangle in the form of which are the grooves parallel to the axis of the capsule is equal to half of the value of the screw-thread from the threading of said capsule. The length of the side of the stop shoulders, parallel to the axis of the bottle, is identical to the length of the side of the right-angled triangle in the form of which are made the grooves, parallel to the axis of the obturatory capsule. The upper closed side from the obturatory capsule is made in the form of a profiled crown and the hollow bottom from the upper part of the hollow cap is equipped with a strangling disposed so that during the coupling of the capsule and of the cap, the profiled crown of said capsule penetrates under the effect of pressure through said strangling of said hollow cap and gives thus the two elements immovable with regard to the other on an axis plane.

The capsule is made of a material sufficiently elastic and deformable to assure deformation from the lower edge and from the sides of the grooves of said capsule under the effect of pressure which occurs during the screwing of the means of the invention when the capsule meets the stop shoulders of the bottle, said material being however sufficiently rigid so as to assure that when the sides of the grooves parallel to the axis of said capsule, being in repeated contact with the sides of the corresponding stop shoulders, don't degrade or change form due to wear during this time.

As noted above, the smallest of the acute angles of the right-angled triangle in the form of grooves on the lower edge from the capsule is determined by the length of its side parallel to the axis of said capsule. This length equal to the length of the sides from the stop shoulders parallel to the axis of the bottle is determined by dividing the value of the screw thread by the number of grooves on the lower edge of said capsule.

It has been found during tests that the power necessary to deform the lower edge of the capsule and the edges of the grooves, is the friction power who appears between said capsules and the stop shoulders of the bottle and in fact guarantees the maintenance of the determined position and that this power depends upon the ratio of the value of the screw thread and the number of grooves for an deformable elastic material and for a predetermined value of the threading.

Tests have shown that the necessary friction power to guarantee the maintenance of the determined position of the means of the invention is obtained when the length of the side of the right-angled triangle in the form of which are made the grooves, the side parallel to the axis of the capsule, is equal to the ratio of the value of the screw thread from the threading of the capsule, the value being expressed in millimeters, for example, and from the number of grooves executed on the lower edge of said capsule.

In the case of one groove on the lower edge of the capsule, the best results, with respect to the compression power and to the resulting friction power, are obtained when the length of the side of the right-angle triangle, parallel to the axis of said capsule, is equal to the value, expressed in millimeters for example, of the screw thread from the threading of said capsule. In the case where two grooves are present on the lower edge of the capsule, said length has to be equal to the half of the value of the screw thread of the threading. In the case of four grooves, the said length must correspond to a quarter of the value of said screw thread. In the case of a greater number of grooves, said length can be obtained by dividing the value of said screw thread by the number of grooves present on the lower edge of the capsule.

By following the above mentioned rule, the right-angled triangle, in the form of which are made said grooves, occurs in such form and has such a size that it can be inscribed in the triangle that is obtained when the projection of said stop shoulders is observed. It can be then ascertained that the area of the first one is necessarily smaller than that of the second one.

It is preferably considered that the number of grooves on the lower edge of the capsule and the number of stop shoulders on the bottle is either from two or from four. Nevertheless, according to the diameter of the capsule and of the cap, this number may be higher.

The material of which the capsule is made is a reasonably rigid material but at the same time slightly elastic and deformable such as, for example, polyethylene or polypropylene. On a rotatory level, the immobility of the obturatory capsule with regard to the cap may be satisfied by either the disposition of axial indentations on the exterior surface of the obturatory capsule and by corresponding throats on the internal surface of the cap, or by disposition of one or more axial small wings on the exterior surface of the capsule and by corresponding throats on the internal surface of the cap. The capsule may also be disposed so that it has simultaneously on its exterior surface, indentations and one or more small wings, with the internal surface of the cap being provided with corresponding throats.

When the capsule has on its exterior surface indentations, and the cap has on its internal surface corresponding throats, the number may vary, according to the necessity, from 4 to 36 for example. When the obturatory capsule has on its exterior surface, one or more small wings, the number of wings is preferably one or two with corresponding throats disposed on the internal surface of the cap.

The cap is made of a rigid material such as a rigid plastic material such as polyvinylchloride, polypropylene, polystyrene or a thermosetting material as the phenolformaldehyde resin or a metal, glass, porcelain, wood or cork. The drawing and the shape of the cap itself may freely vary according to the required visual appearance of the finished shape of the bottle with which it is associated during the closing. The shoulder or the stop shoulders may be made with a wing being a part of the neck of the bottle itself. The bottle itself is more preferably made of a normally rigid material such as glass or porcelain to guarantee the non-deformability of stop shoulder(s). However, the bottle itself may be made of an elastically deformable plastic material, but in this event it is necessary to make certain that the portion where the stop shoulder is formed is not itself deformable. A solution to such an arrangement would be, for example, to prepare separately the wing itself of a non-deformable material and to associate it with the elastically plastic deformable bottle by well known process.

The diameter of the strangling of the hollow bottom of the cap is disposed to permit the passing of the effect of pressure from the profiled crown to the upper closed extremity of the capsule. After the said crown has passed through the strangling, the capsule is in place and stays immovable with regard to the cap on an axis plane. While in the example, the stop shoulder(s) are executed on a wing as a part of the neck of the bottle, it can also being considered that they can be made on the body of the bottle itself.

The closing of the aperture of the bottle is accomplished by means of a chimney or by means of a stopper at the upper extremity of the capsule. These elements may be made in a slightly conical or a cylindrical form. In the latter instance, its extremity which has to penetrate into the aperture is contracted in the form of a cone to facilitate the penetration of said chimney or of said stopper into the aperture of the bottle.

Depending on the choice of the different elements constituting the means of the invention or to the arrangement of its elements, it is possible to guarantee the maintenance of a determined position of the means of the invention with regard to the bottle when it is closed, after and between each closure without any risk that this predetermined position shall be in time or accidentally modified and consequently so that the hermetic state of the bottle shall not be endangered and that the profile of the whole shall not be changed.

The drawing gives an example of one embodiment of the invention in which the dimensions are often exaggerated for illustrative purposes.

Figure 2:
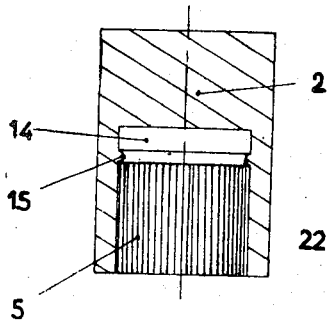
FIG. 1 is an exploded cross-sectional view of one end of the closure means and bottle of the invention and FIG. 2 is a cross-sectional view of the cap.
Figure 6:
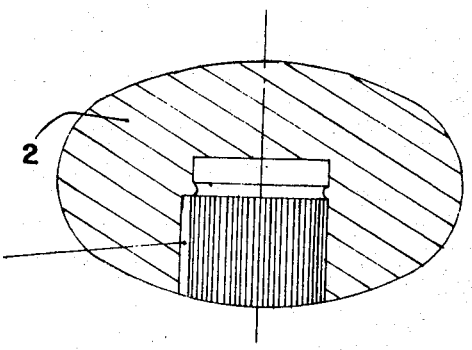
FIG. 6 is a schematic cross-sectional view of another cap form with a throat destined to receive the small wing of the corresponding capsule.
Figure 5:
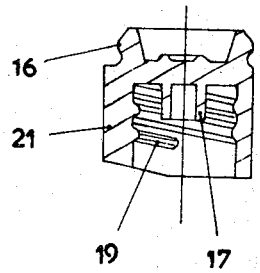
FIG. 5 is a schematic cross-sectional view of the upper closed part of the capsule provided with a small wing.

In these drawings. (1) is the capsule of the bottle and (2) is the cap destined to have a required position with regard to the bottle (3) and axial indentations (4) are placed on the exterior surface of the capsule (1) and the throats (5) are placed on the internal surface of the cap (2) to receive the indentations. One of the grooves (6) in the form of a right-angled triangle, representing the means for guaranteeing the security of the required position, is executed on the lower edge of the capsule (1) with the collar (7) being a part of the bottle (3) placed on the neck of said bottle. One of the stop shoulders (8) is formed on the collar (7) with the oblique side (9) of the groove (6) and the side (10) of the groove (6) parallel to the axis of the capsule. The slope (11) of the stop shoulder (8) and the side (12) of the stop shoulder (8) is parallel to the axis of the neck of the bottle (3) and the top (13) of the stop shoulder (8). The hollow bottom (14) of the cap (2) has a strangling (15) destined to receive the upper closed extremity of the capsule (1) made in the form of a profiled crown.

The chimney (17) is at the upper closed part of the capsule (1) destined to close the aperture (18) of the bottle (1). The threading (19) is on the internal surface of the capsule (1) in its lower part. The threading (19) is on the neck of the bottle (3) and a small wing is placed axially on the external surface of the obturatory capsule (1). The throat (22) is formed on the internal surface of the cap (2) destined to receive the small wing.

During manufacture of the means of the invention, the capsule (1) and the cap (2) are separately made by usual processes such as molding, fashioning or machining. It is then possible to assemble these elements. The capsule (1) may be introduced into the hollow of the cap (2) by disposing indentations (4) into the throats (5). Under the effect of pressure applied on the capsule (1), the profiled crown (16) of this last is formed pass the strangling (15) of the hollow of the cap (14) and sets itself at the bottom of the said hollow (14). Similarly, the capsule can be provided with one or more small wings and the cap with one or more corresponding throats.

The disposing of the cap in the cap may be done manually or with a machine. The coupling of the cap and of the capsule may be done as mentioned above or before proceeding to the closing of the bottle by placing the capsule on the bottle and by screwing it till it stops and then by placing the cap on the capsule in the same manner as above indicated. Whether the assembling of the cap (2) with the capsule (1) is done previous to the closing of the bottle (3) or it is proceeded to a first screwing of the capsule (1) only on the bottle (3) and then the cap (2) is placed on the capsule (1), the process of placing the groove (6) of the obturatory capsule (1) on the stop shoulders (8) of the wing (7) from the bottle remains the same.

During the screwing of the whole cap (2) with the obturatory capsule (1), the closing of the bottle occurs in a first stage by the chimney (17) of the capsule (1) penetrating into aperture (18) of the bottle (3) and completes the closing, without the bottom of the closed extremity of said capsule (1) touching the neck of the bottle (3).

Due to the clearance which may exist in the tolerance of the manufacturing between the threading of the capsule (1) and the threading of the neck of the bottle, it may occur that the said bottom touches the neck of the bottle (3).

During the process of the screwing, the grooves (6) of the lower edge of the capsule (1) keep coming nearer in a first step to the stop shoulders (8), from the collar (7), and from the neck of the bottle (3), and as said capsule (1) continues to go ahead on the side of the bottle (3), its non-grooving edge starts to contact the top (13) to stop shoulders (8). After this contact, as the screwing proceeds, a first deformation of the capsule (1), more precisely at the lower edge, occurs.

As the progress of the capsule (1) on the neck of the bottle (3) proceeds under the effect of screwing, the beginning of the grooves (6) go above the tops (13) of the stop shoulders (8) and the process of fitting of the stop shoulders (8) with the grooves (6) is in course. It continues until the sides (10) of the grooves (6) parallel to the axis of the capsule (1) come in contact with the sides (12) of the stop shoulders (8) parallel to the axis of the neck of said bottle (3).

During this last step, the oblique sides (9) of the grooves (6) of the capsule (1) still continue to be deformed by the angle difference of the said oblique sides (9) of the grooves (6) and the slope (11) of the stop shoulders (8).

The compression power and the resulting friction which occurs between the two said parts, the capsule (1) and the stop shoulders (8), doesn't stop increasing during the screwing.

At the time when the sides (10) of the grooves (6) comes in contact with the sides (12) of the stop shoulders (8), the required determined position of the means according to the invention is accomplished. At this point, a part of the oblique sides (9) of the grooves (6), and the parts of the lower edge of the obturatory capsule (1), to the grooves (6) are notably deformed, and the compression power due to the friction between the two parts (the capsule (1) and the stop shoulders (8)) are at their maximum. The friction is sufficient to make the two parts (1) and (8) immovable with regard to each other and this guarantees the maintaining of the position according to the invention as well as the hermetic state of the bottle.

Figure 7:
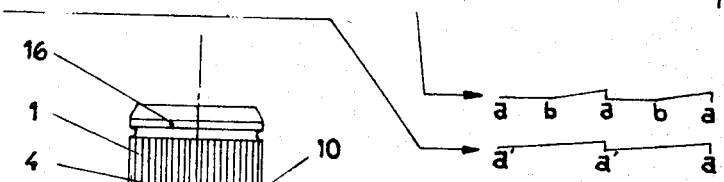
FIG. 7 is a schematic developed view of the stopping system.
Figure 3:
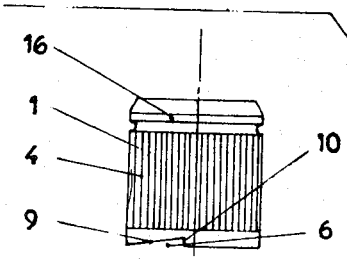
FIG. 3 is a schematic profile view of the obturatory capsule having indentations and FIG. 4 is a schematic profile view of the upper part of the bottle.
Figure 4:
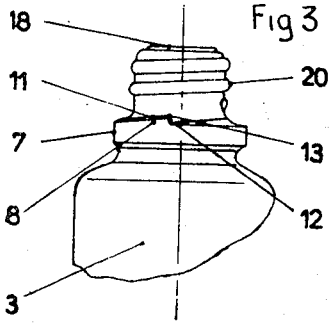
Figure 1:
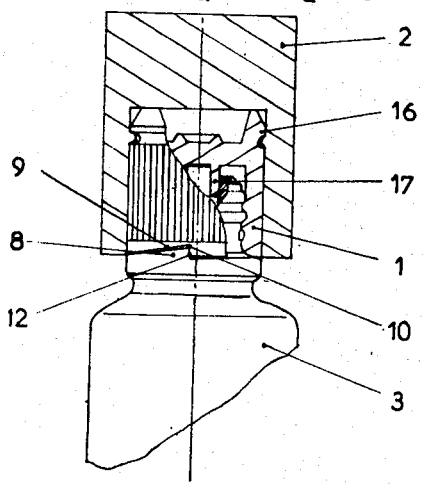

The functioning of the means of the invention may also be illustrated by FIG. 7. In this figure, the development of the grooves (6) of the lower edge of the capsule (1) and of the stop shoulders (8) of the collar (7) of the neck of the bottle (3) are compared. It can be seen from these drawings that the profile of the grooves (6) and of the stop shoulders (8) are not identical.

If, in the state where the side (10) of the right angled triangle parallel to the axis of the capsule (1) is in contact with the side (12) of the stop shoulders parallel to the axis of the bottle (3), it proceeds to the superposition of the profiles of said development, their sides a and a' respectively corresponding to said sides (10) and (12), would be in contact and said capsule would not be deformed at this point.

On the other hand, during the superposition of said profiles, due to their difference in the shapes of the grooves (6) and of stop shoulders (8), it can be ascertained that point b of the development of the grooves which start at the beginning of the grooves (6) would be displaced by the deformability of the capsule. This schematic illustration corresponds to the deformation that the capsule undergoes at certain places.

The capsule would then be compressed and deformed at these points and the friction would then occur between the capsule (1) and the stop shoulders (8).

During the voluntary opening of a bottle closed with a means of the invention, it is necessary to apply to the cap (2) connected to the capsule (1) a sufficient unscrewing power to overcome the present friction so that simultaneously the tops (13) of the stop shoulders (8) disconnect the position they have taken during the closing of the present means, and the oblique sides (9) of the right-angled triangles which are in the form of grooves (6) may go up the slopes (11) of stop shoulders (8).

Obviously the invention should not have to be limited to the above mentioned and represented execution form when its includes all the variances.

I claim:

1. A bottle with a prealigned closure means comprising a bottle with a neck on the top thereof provided with a threading and a collar at the base thereof having stop shoulders, said shoulders each having an oblique side with an associated inclination angle, a capsule with a closed end provided with an interior threading adapted to engage the threading of the bottle neck, a hollow cap means with the capsule axially disposed therein and provided with means to immoveably secure the capsule with respect to the cap, the lower edge of the capsule being provided with two diametrically opposite grooves in the form of a right-angle triangle whose side opposite the smaller of the acute angles is parallel to the axis of the capsule, the said smaller acute angle determining the inclination of the oblique side of the said right-angled triangle, said smaller acute angle being greater than the inclination angle of the stop shoulders of the bottle with which the grooves are destined to cooperate.

2. A bottle with a closure means of claim 1 characterized in that the length of the side of stop shoulders, parallel to the axis of the bottle, is identical to the length of the side parallel to the axis of the capsule of the right-angled triangle.

3. A bottle of claim 1 characterized in that the capsule is made of a material sufficiently elastic and deformable to assume the deformation from the lower edge and from the sides of the grooves of said capsule under the effect of pressure which occurs during the screwing on or off of the closure means when the capsule meets the stop shoulders of the bottle, said material being sufficiently rigid to assure that when the sides of the grooves parallel to the axis of the said capsule which are in repeated contact with the sides of the corresponding stop shoulders will not degrade in time.

* * * * *